US007228811B2

(12) United States Patent
Huff et al.

(10) Patent No.: US 7,228,811 B2
(45) Date of Patent: Jun. 12, 2007

(54) MULTIPLY HINGED SUNDECK FOR PONTOON BOAT

(75) Inventors: Kevin L. Huff, Owosso, MI (US); Wayne W. Cortner, Fenton, MI (US)

(73) Assignee: Maurell Products, Inc., Owosso, MI (US)

( * ) Notice: Subject to any disclaimer, the term of this patent is extended or adjusted under 35 U.S.C. 154(b) by 0 days.

(21) Appl. No.: 11/251,243

(22) Filed: Oct. 14, 2005

(65) Prior Publication Data

US 2006/0130724 A1 Jun. 22, 2006

Related U.S. Application Data

(60) Provisional application No. 60/640,136, filed on Dec. 22, 2004.

(51) Int. Cl.
*G63B 17/00* (2006.01)

(52) U.S. Cl. ..... 114/343; 114/61.1; 114/201 R

(58) Field of Classification Search ..... 114/61.1, 114/201 R, 202, 343, 363; 440/76
See application file for complete search history.

(56) References Cited

U.S. PATENT DOCUMENTS

| | | | | |
|---|---|---|---|---|
| 4,892,052 | A * | 1/1990 | Zook et al. | 114/61.1 |
| 6,263,825 | B1 * | 7/2001 | Davidson | 114/343 |
| 6,302,053 | B1 | 10/2001 | Tomczak et al. | 114/363 |
| 6,477,969 | B2 | 11/2002 | Schell-Tomczak et al. | 114/61.1 |
| 6,482,056 | B1 | 11/2002 | Schell-Tomczak et al. | 440/53 |
| 6,672,240 | B1 | 1/2004 | Aubé et al. | 114/343 |
| 6,886,490 | B2 | 5/2005 | Aubé et al. | 114/363 |
| 2003/0127034 | A1 * | 7/2003 | Scott et al. | 114/61.1 |

* cited by examiner

*Primary Examiner*—Lars A. Olson
(74) *Attorney, Agent, or Firm*—Welsh & Katz, Ltd.

(57) ABSTRACT

An engine compartment cover for watercraft incorporates first and second pivots The cover can be rotated from an adjacent engine compartment in a first direction to a second location to provide a convenient access to the engine from the stern of the watercraft. Alternately, a portion of the cover can be rotated in the opposite direction on the second pivot to provide access to the engine compartment from the deck of the craft.

19 Claims, 11 Drawing Sheets

MULTIPLY HINGED SUNDECK FOR PONTOON BOAT

CROSS REFERENCE TO RELATED APPLICATION

This application claims the benefit of the filing date of U.S. Provisional Application Ser. No. 60/640,136 filed Dec. 22, 2004 and entitled "Multiply Hinged Sundeck for Pontoon Boat".

FIELD

The invention pertains to pontoon boats. More particularly, the invention pertains to such boats with easy-to-access engines to facilitate maintenance.

BACKGROUND

Known pontoon boats usually have an elongated deck with a bow and a stern. The deck is supported in the water by two or three pontoons. Some known pontoon boats incorporate an inboard/outboard-type engine in an engine compartment located at the stern of the deck. The engine compartment is usually centrally located relative to the width of the deck with the outboard portion of the engine extending axially generally on a center line of the deck.

One of the problems with many known pontoon boats that have inboard/outboard engines relates to ease of engine maintenance. The engines are often located in a recessed engine compartment. For example, hinged seats or a sundeck may cover and close the engine compartment.

The seats and/or sundeck are usually attached by a pivot, or hinges to the stern of the boat. Hence, the seats and/or sundeck must be rotated upwardly from the deck toward the stern. When the seats and/or sundeck are so rotated, the compartment cannot be reached from the stern. Instead, it can only be reached from the deck.

Providing a pivot or hinge structure at the stern of the watercraft for the seats/sundeck, as described above, precludes access to the engine from the stern of the watercraft. On the other hand, it may be desirable at times to access the engine from the deck, for example, where the boat is in deep water.

Often the inboard section of the engine, in the compartment is 24 or more inches below deck level. This location can require maintenance personnel to kneel or lay on the deck to reach the engine. Neither of these postures contributes to efficiency or ease of maintenance. In some known instances, the opening to the engine compartment is not as wide as the engine is long. The engine thus extends, at least in part, under the deck. This also contributes to inconvenience and difficulty in carrying out maintenance makes engine maintenance more difficult and less convenient than desired.

Thus, it would be desirable to be able to configure engine compartments for pontoon boats to facilitate easier maintenance. It would be especially desirable if the engine would be readily accessible from the stern of the boat without having to get up on the deck to carry out maintenance procedures.

Since many such watercraft do not carry an enclosed cabin it would be desirable to be able to incorporate a temporary changing room or privacy region on such watercraft provided such could be done without compromising access to the engine compartment. One such privacy structure has been disclosed in Tomczak et al. U.S. Pat. No. 6,302,053 B1 issued Oct. 16, 2001 entitled "Boat Mountable Stowable Enclosure". The Tomczak et al. patent is assigned to the Assignee hereof and incorporated by reference herein. It would be further desirable to be able to combine an engine hatch which provides for more convenient access to the engine from the stern of the watercraft than has heretofore been available while at the same time providing a temporarily deployable privacy region of the type generally disclosed in the above noted Tomczak et al. patent.

DETAILED DESCRIPTION

Figure 1:
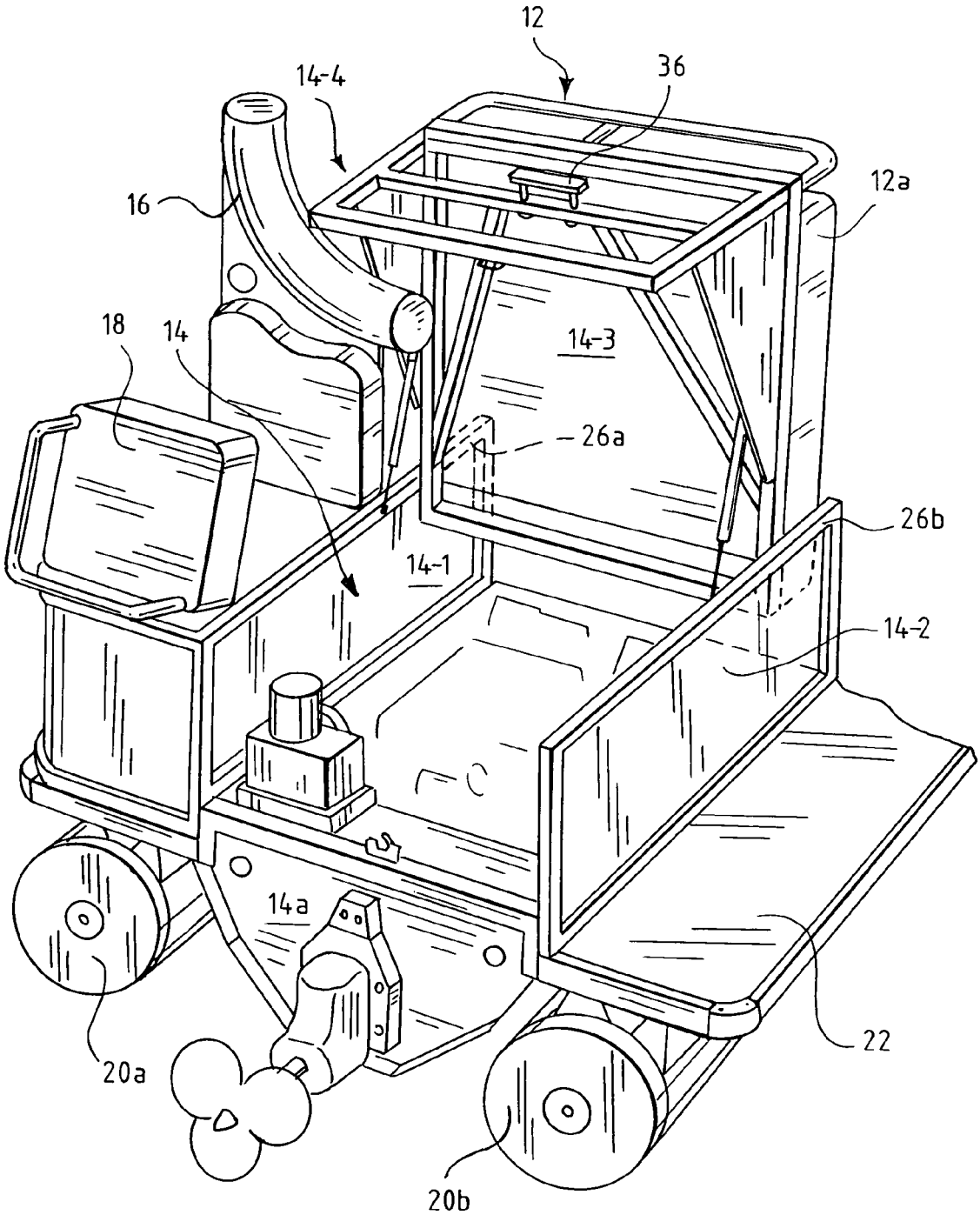
FIG. 1 is a perspective view of a pontoon boat in accordance with the invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 is a perspective view of a pontoon boat 10 viewed from the stern thereof. The boat 10 incorporates a multiply hinged sundeck 12. When rotated upwardly, as illustrated in FIG. 1, the sundeck exposes an engine compartment indicated generally at 14 which includes an inboard portion E of an inboard/outboard engine. The outboard portion E1 is coupled to the stern 14*a* of the engine compartment.

A flip-up privacy unit 16 can be located adjacent to one side of the sundeck 12. Further, an additional hinged sundeck 18 can be provided to provide access to an underlying fuel cell. For example, the fuel cell might contain a 37-gallon fuel tank for the engine E.

The boat 10 includes pontoons 20*a, b* and has a deck 22.

The engine compartment 14, as illustrated in FIG. 1, is bounded on first and second sides by members 14-1 and 14-2.

The rotatable sundeck 12 is pivotally attached to the bounding members 14-1, -2. It can be rotated away from the stern 14*a* of the engine compartment, as illustrated in FIG.

1, to thereby make the inboard portion of E the engine readily accessible for maintenance.

In the configuration illustrated in FIG. 1, the inboard portion E of the engine can be easily accessed from the stern of the boat 10. The configuration of the engine compartment, as illustrated in FIG. 1, is especially advantageous in that a person conducting maintenance can stand at the stern of the engine compartment, open the sundeck 12 as illustrated in FIG. 1, and not have to kneel or lay down on the deck to reach the engine. Further, to the extent that the maintenance activities involve oil or grease, those materials will tend to be retained between the sidewalls 14-1, -2 of the engine compartment 14 and will soil or damage any of the sundeck or seats.

The sundeck 12 carries a cushion 12*a* on top of an engine compartment closing panel 14-3. The stern portion of the engine compartment is closed by a panel 14-4 also carried by the sundeck 12.

Figure 2:
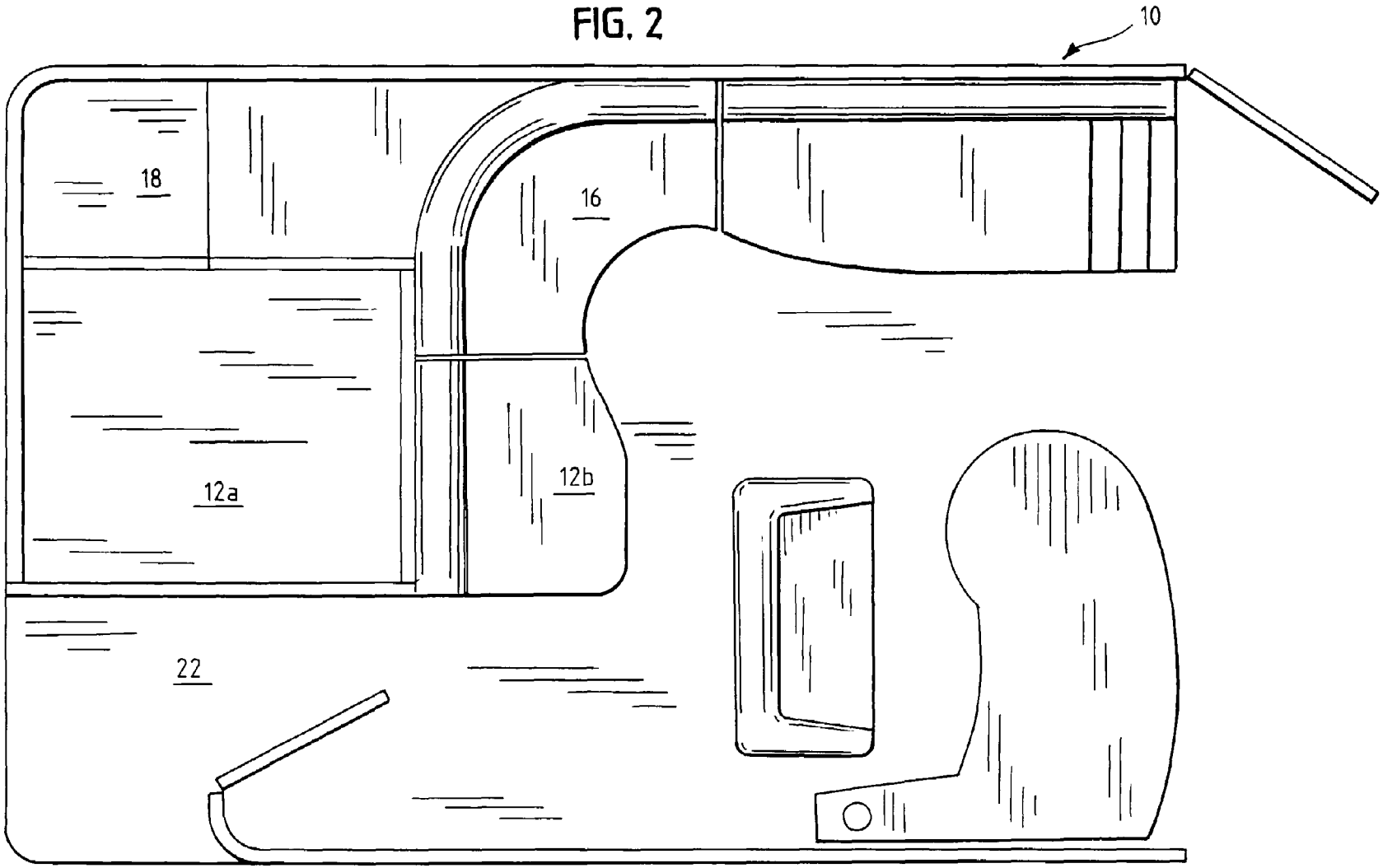
FIG. 2 is a top plan view of the boat of FIG. 1 with the engine compartment closed.
Figure 3:
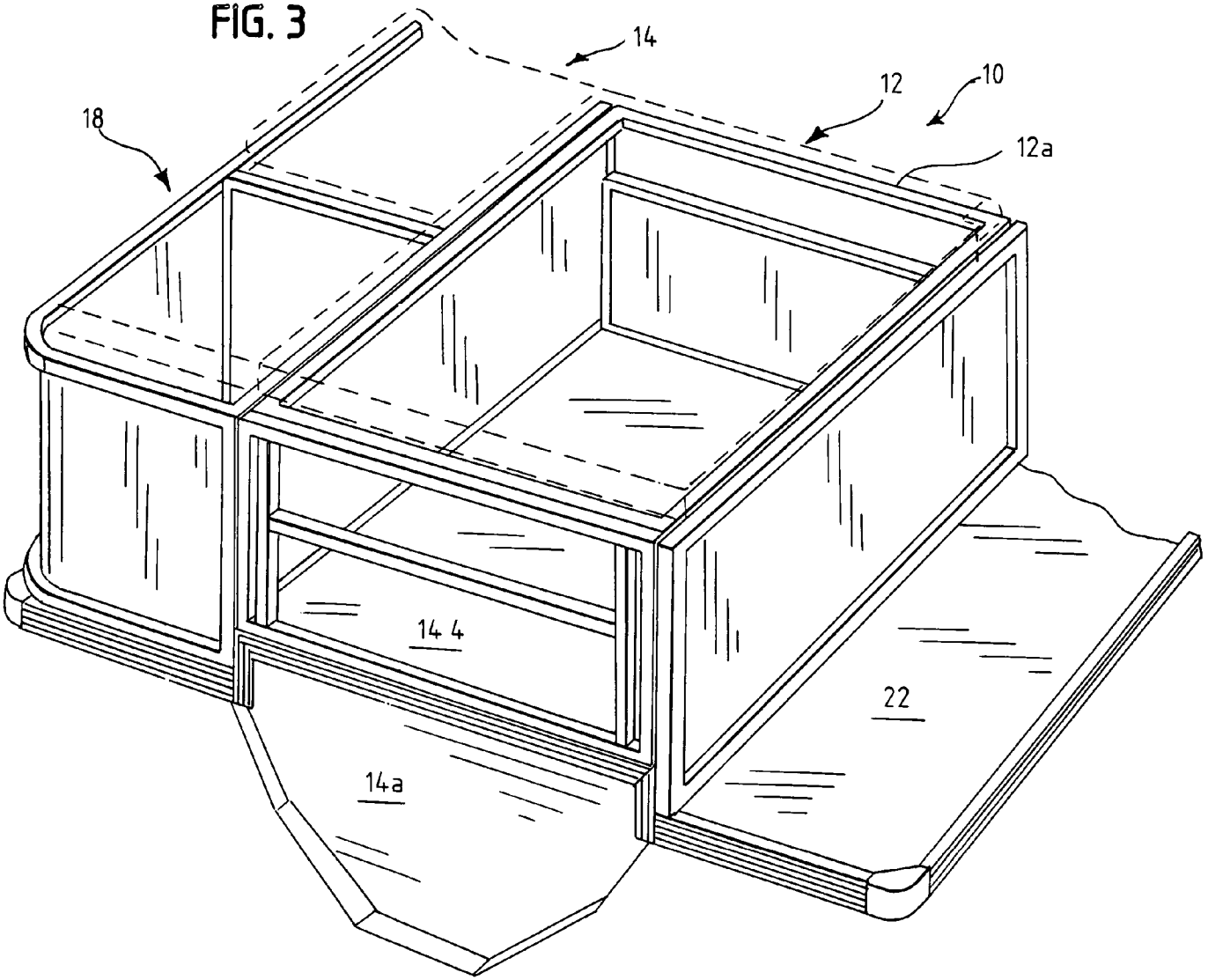
FIG. 3 is a perspective view from the stern of the boat of FIG. 1 with the engine compartment closed.
Figure 4:
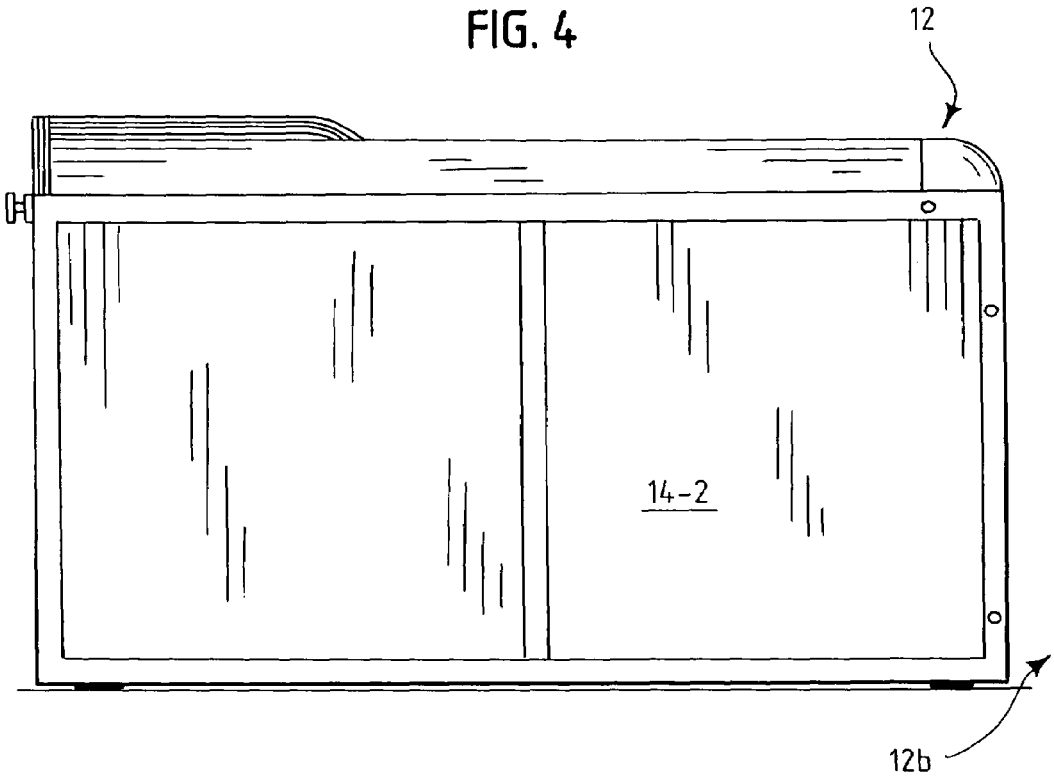
FIG. 4 is an elevational view of the port side of the stern of the boat of FIG. 1 with the engine compartment closed.

FIGS. 2, 3 and 4 are of various views of the boat 10 with the hatch for the engine compartment 14 in a closed state. As illustrated therein, the cushions 12*a* which overlie the enclosure panel 14-3 completely close the top of the engine compartment 14. Seating 12*b* can be located adjacent to the sundeck 12.

Figure 5:
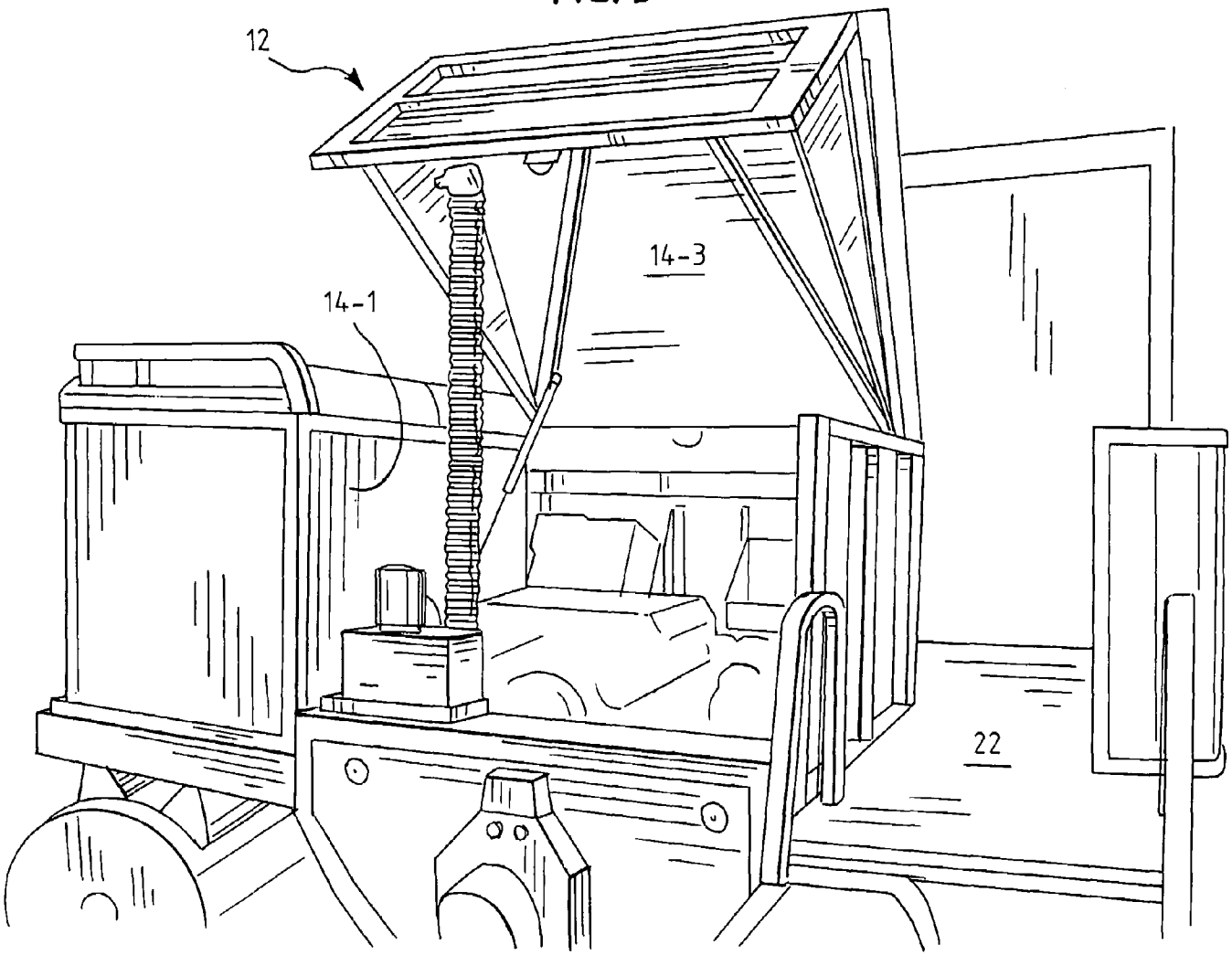
FIG. 5 is a view of the stern of the boat of FIG. 1 with the engine compartment opened.
Figure 6:
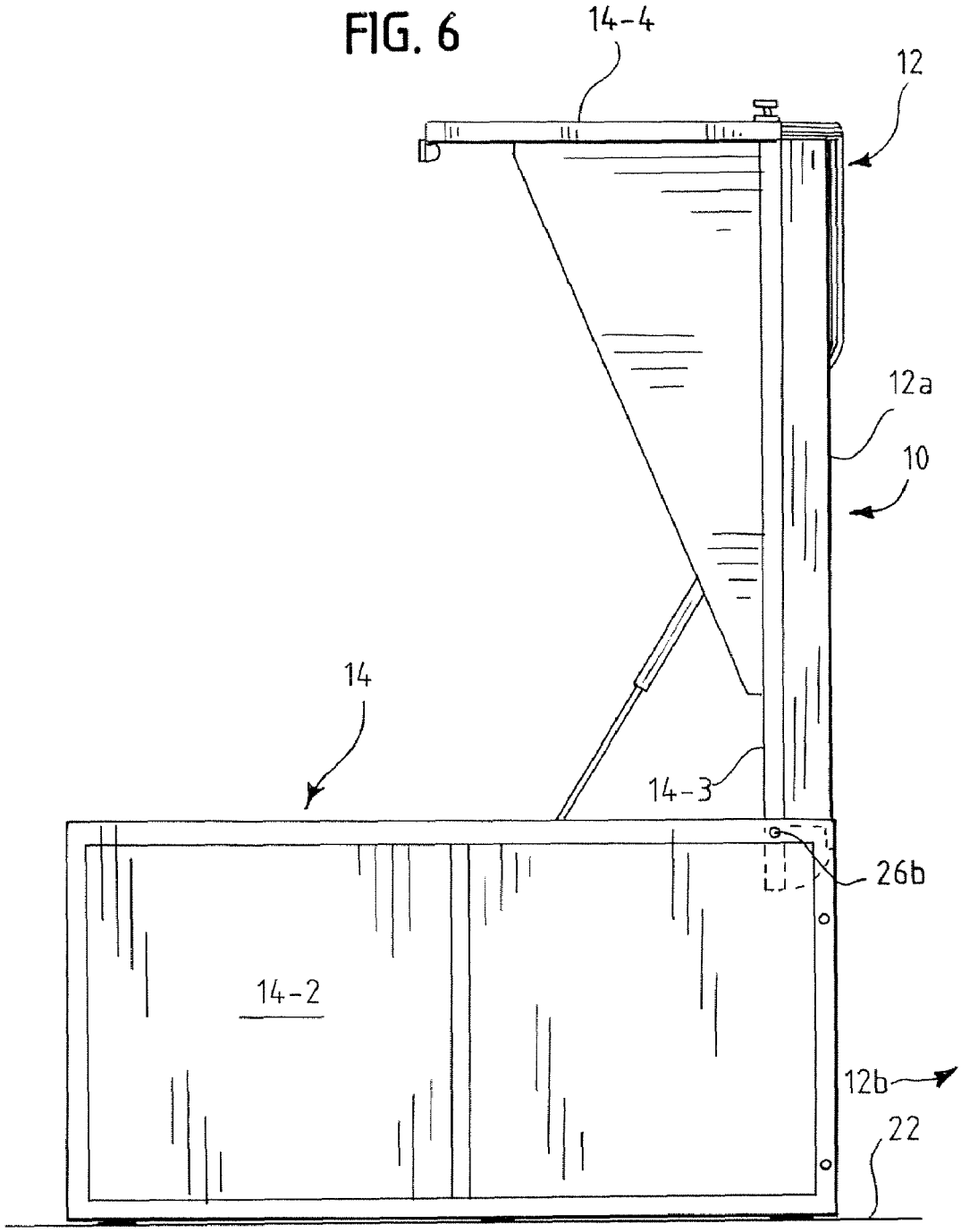
FIG. 6 is a side elevational view of the stern of the boat of FIG. 1 with the engine compartment opened.
Figure 7:
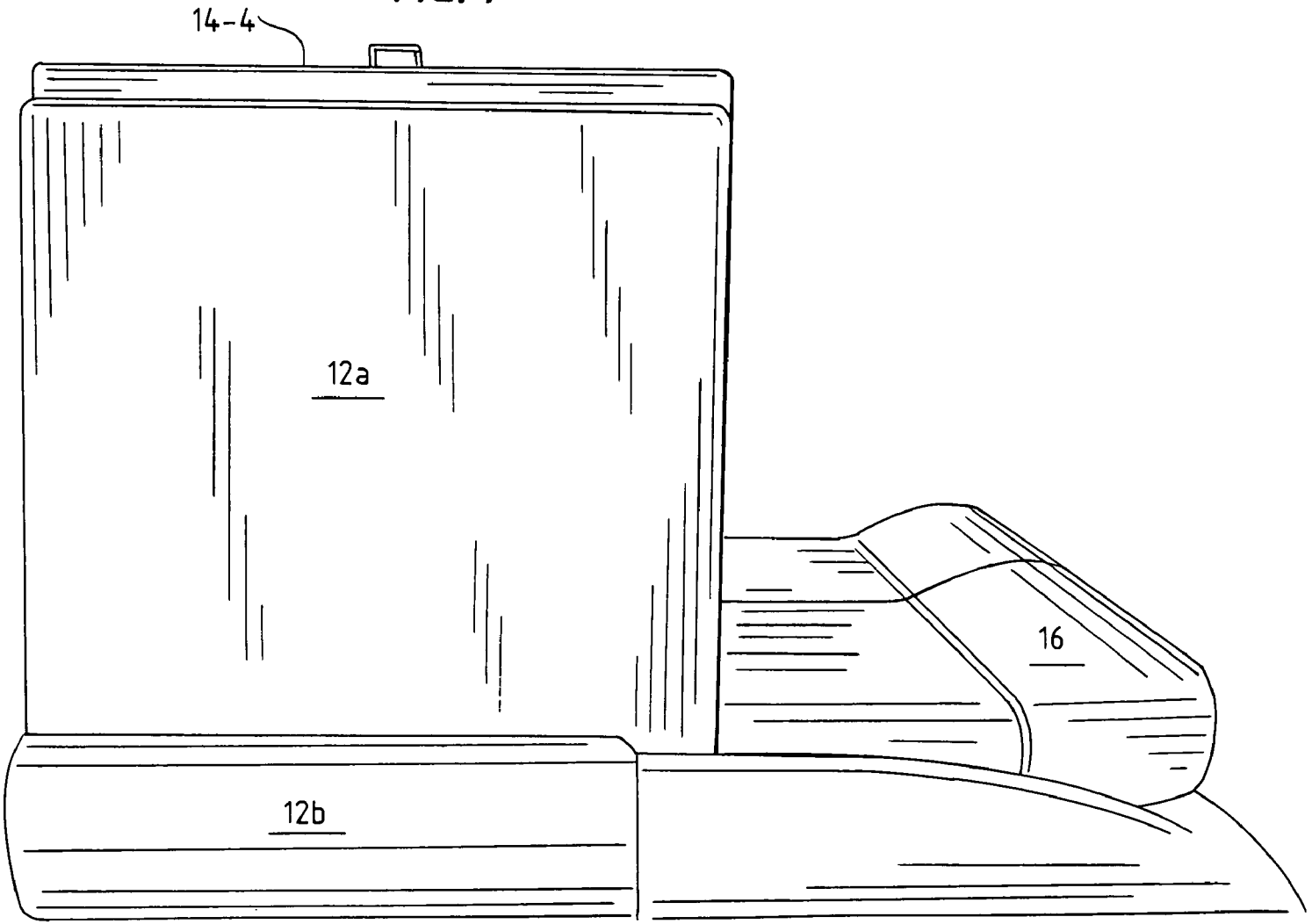
FIG. 7 is a view of the sundeck of the boat of FIG. 1, as seen from the deck of the boat with the engine compartment opened.

FIGS. 5-7 illustrate various views of the boat 10 with the engine compartment 14 open. As illustrated therein with the hinged sundeck 12 rotated upwardly away from the stern of the boat 10 the inboard portion E of the engine is readily accessible from the stern of the boat.

Figure 8:
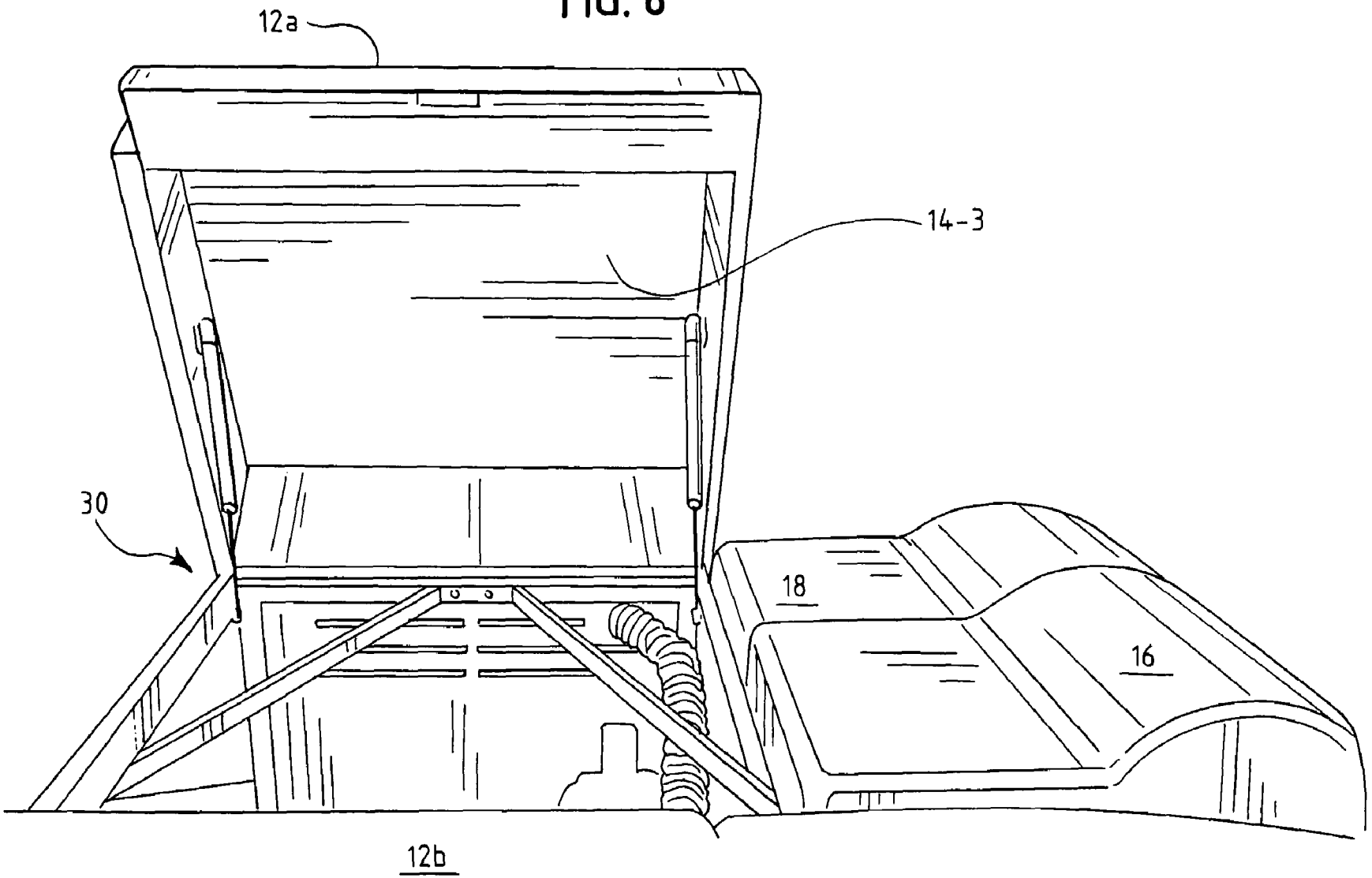
FIG. 8 is a view of the sundeck of the boat of FIG. 1 opened to provide access to the engine compartment from the deck of the boat.
Figure 9:
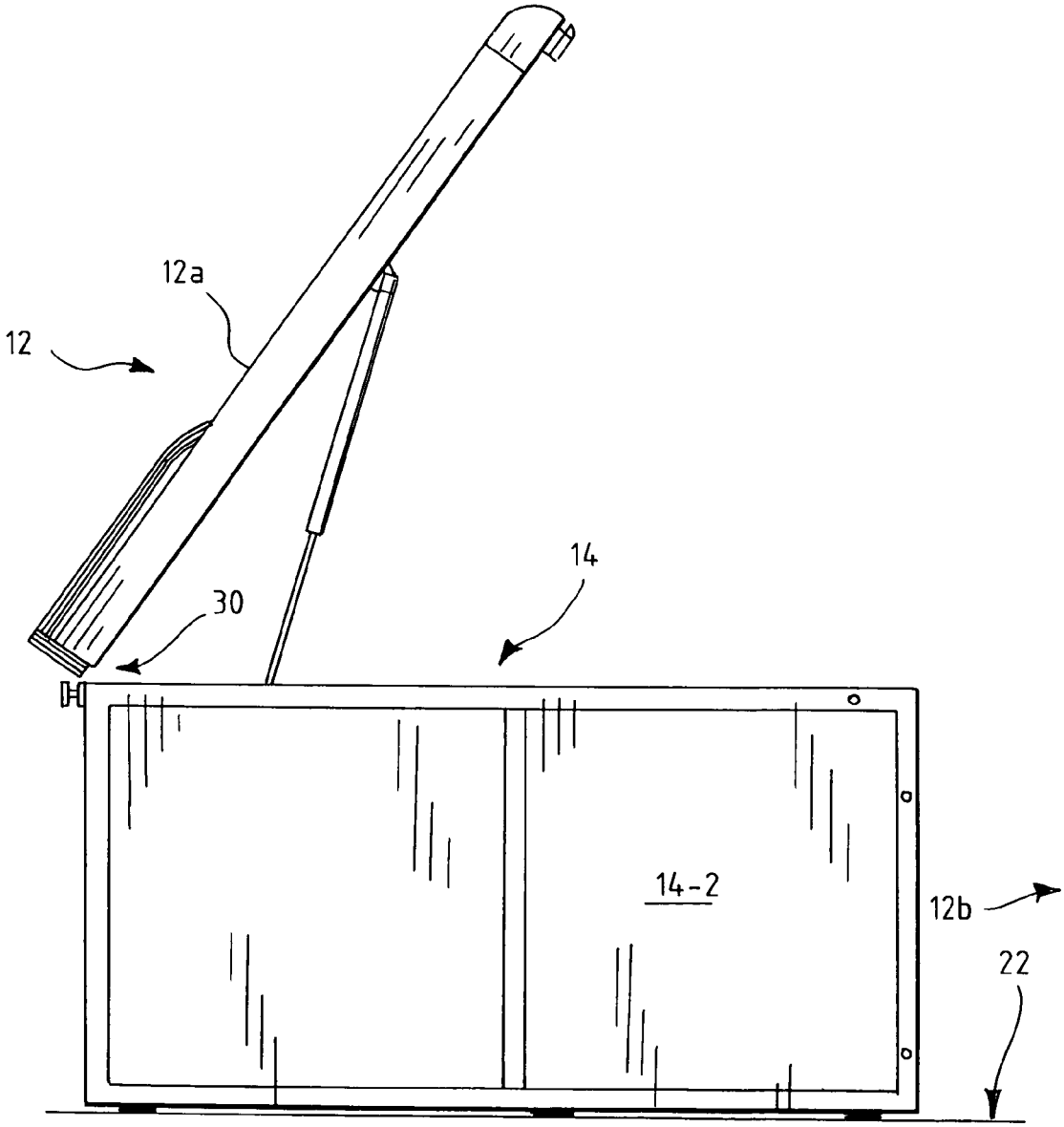
FIG. 9 is a side elevational view of the stern of the boat with the sundeck opened to provide access to the engine compartment of the deck.

FIGS. 8 and 9 illustrate views of the boat 10 with the sundeck 12 rotated to open engine compartment 14 for access from the deck 22 of the boat. As illustrated therein, the sundeck 12 has a second hinge or pivot indicated generally at 30 whereby the cushion 12*a* and underlying panel 14-3 can be rotated upwardly toward the stern. As illustrated in FIGS. 8 and 9, the engine compartment 14 can be readily accessed from the deck 22 in this configuration.

Figure 10:
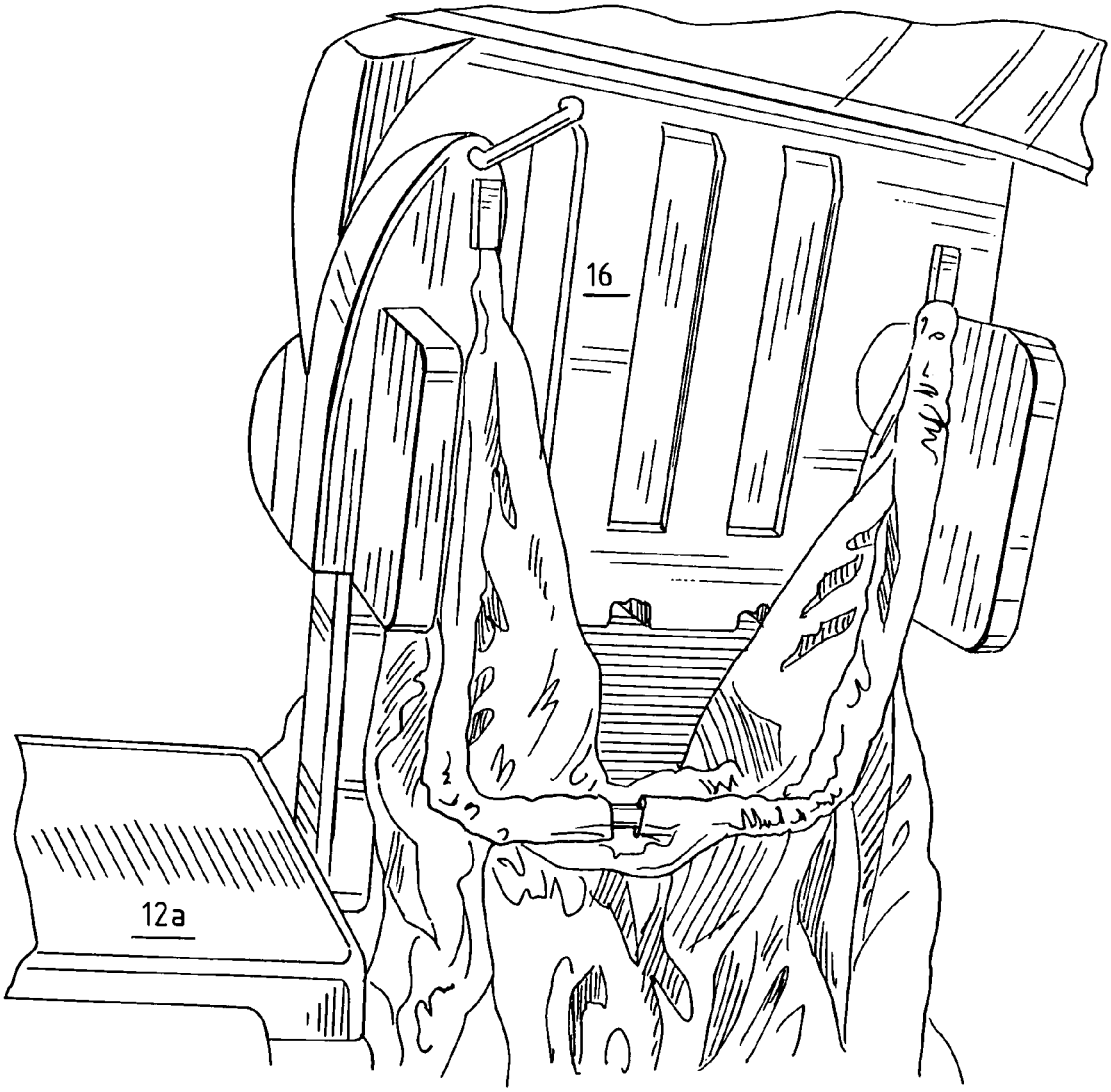
FIG. 10 is a partial view of the cover for the privacy unit rotated to a location where the privacy unit would be deployed.
Figure 11:
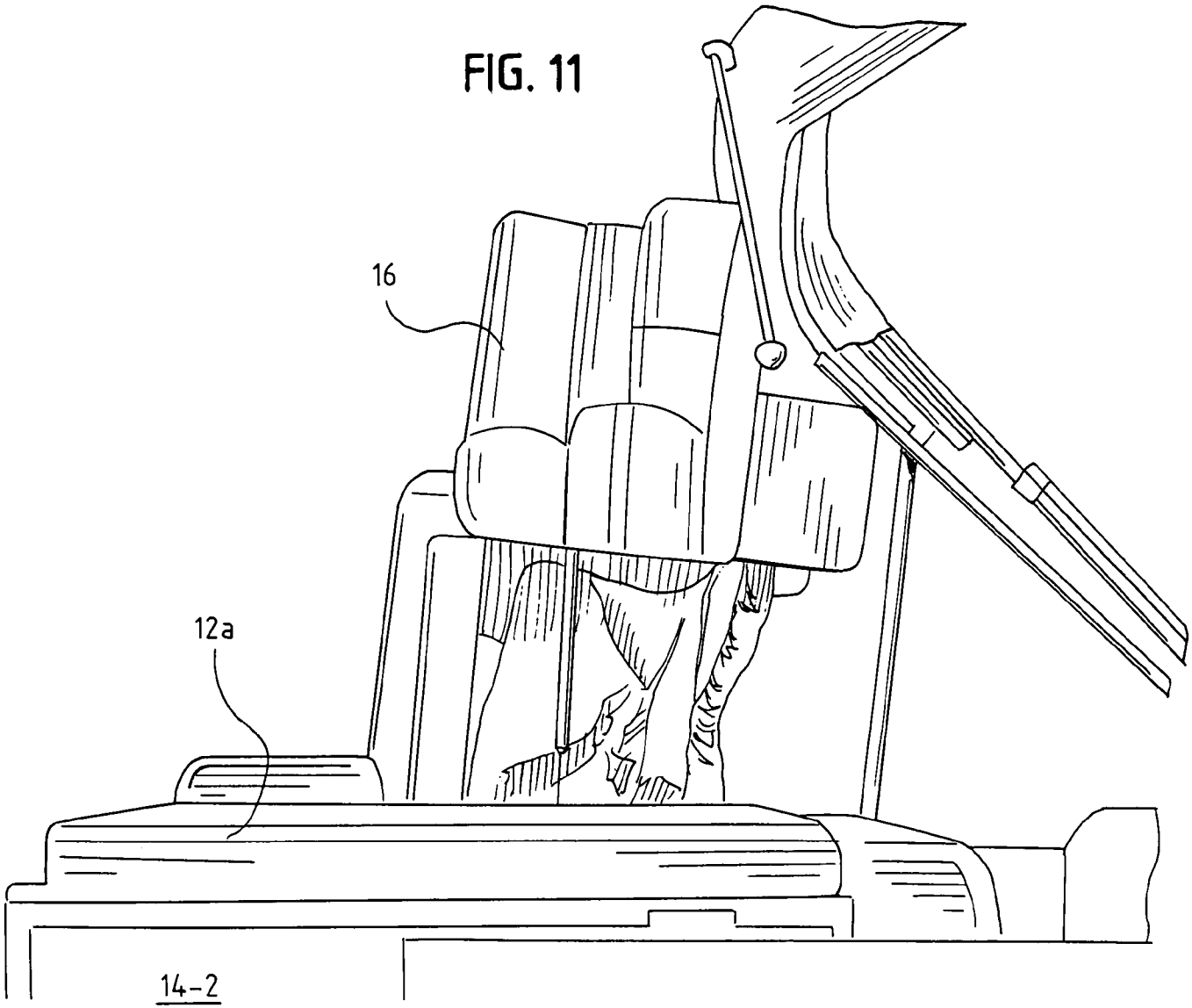
FIG. 11 is a view of the structure of FIG. 10 from the side of the boat.

FIGS. 10 and 11 illustrate various details of the instruction of the flip-up privacy unit 16. The privacy unit 16 can be implemented in accordance with the teachings of the Tomczak et al. U.S. Pat. No. 6,302,053 B1 incorporated herein by reference. In FIG. 1, the portion of the sundeck and related seat 16 are illustrated in an open position which deploys the privacy unit. FIG. 11 illustrates the opened position of the unit 16 with a view from the side of the boat.

It will be understood that the sundeck 14 can be locked into a closed position closing the engine compartment 14 via latch 34. The latch 34 can be released by way of a remote cable from the captain's stand of the boat 10, if desired. Alternately, the latch 34 can be configured to be released locally at the stern of the boat. An optional ski tow 36 can be added to the frame for the sundeck 12.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A pontoon boat comprising:

a deck having first and second spaced-apart ends;

an engine compartment formed adjacent to one of the ends, the compartment having an open top and a stern end;

an engine hatch, rotatably carried adjacent to the engine compartment by a dual pivoted frame where the hatch has a first position which closes the top and stern end of the engine compartment, the hatch is rotatable in a first direction, away from the stern end, to a second position which exposes the top and the stern end thereof.

2. A boat as in claim 1 where the hatch carries an outwardly facing sundeck.

3. A boat as in claim 1 where the hatch has a latch openable from one of the stern end, or, a displaced location on the deck.

4. A boat as in claim 3 which includes an engine mounted in the engine compartment with the engine exposed, at the stern end, for maintenance when the hatch is at the second position.

5. A boat as in claim 4 which includes a rotatably mounted privacy structure.

6. A boat as in claim 5 where the privacy structure has a first, stowed, state and a second, deployed, state.

7. A pontoon boat comprising:

a deck having first and second spaced-apart ends;

an engine compartment formed adjacent to one of the ends, the compartment having an open top and a stern end;

an engine hatch, rotatably carried adjacent to the engine compartment where the hatch has a first position which closes the top and stern end of the engine compartment, the hatch is rotatable in a first direction, away from the stern end, to a second position which exposes the top and the stern end thereof and which includes a rotatable outwardly facing fuel compartment cover.

8. A pontoon boat comprising:

a deck having first and second spaced-apart ends;

an engine compartment formed adjacent to one of the ends, the compartment having an open top and a stern end;

an engine hatch, rotatably carried adjacent to the engine compartment where the hatch has a first position which closes the top and stern end of the engine compartment, the hatch is rotatable in a first direction, away from the stern end, to a second position which exposes the top and the stern end thereof and which includes an element for rotating the hatch in a direction opposite the first direction, toward the stern end thereby exposing the top of the compartment.

9. A pontoon boat comprising:

a deck having first and second spaced-apart ends;

an engine compartment formed adjacent to one of the ends, the compartment having an open top and a stern end;

an engine hatch, rotatably carried adjacent to the engine compartment where the hatch has a first position which closes the top and stern end of the engine compartment, the hatch is rotatable in a first direction, away from the stern end, to a second position which exposes the top and the stern end thereof, which includes a privacy unit having a section rotatably mounted adjacent to the engine compartment and which includes a pivot for rotating the hatch in a direction opposite the first direction, toward the stern end thereby exposing the top of the compartment.

10. A boat as in claim 9 which includes an engine mounted in the engine compartment with the engine exposed, for maintenance when the hatch is at the second position.

11. A pontoon boat comprising:

a deck having first and second spaced-apart ends;

an engine compartment formed adjacent to one of the ends, the compartment having an open top and a stern end;

an engine hatch, rotatably carried adjacent to the engine compartment where the hatch has a first position which closes the top and stern end of the engine compartment, the hatch is rotatable in a first direction, away from the stern end, to a second position which exposes the top and the stern end thereof where the hatch includes a dual pivoted frame rotatable in part in the first direction and in part, opposite the first direction.

12. A boat comprising:

a bow and a stern with a deck extending therebetween;

an engine compartment located adjacent to the stern, the compartment having at least an open side that extends parallel to the deck;

an engine carried at least in part in the engine compartment, the engine being accessible from the open side of the engine compartment;

an engine compartment cover, the cover having first and second spaced apart pivots, the cover, when in a first position, closing the engine compartment, the cover is rotatable on one pivot away from the stern thereby providing access to that part of the engine in the compartment from the stern, and rotatable on the other pivot toward the stern thereby providing access to compartment from the deck.

13. A boat as in claim 12 which includes first and second spaced apart pontoons coupled to the deck, the engine compartment is between at least portions of the pontoons.

14. A boat as in claim 13 where the engine compartment cover carries a cushion on an exposed surface thereof.

15. A boat as in claim 13 which includes a deployable privacy region.

16. A boat as in claim 13 where the privacy region is rotatably carried on the deck.

17. A boat as in claim 12 with the cover having first and second sections, a cushion is carried on one section with the other section extending generally perpendicular thereto.

18. A boat as in claim 17 where the other section closes the engine compartment, at least in part, when the cover is in the first position.

19. A boat as in claim 18 which carries a rotatably mounted deployable privacy enclosure.

* * * * *